US005833449A

United States Patent [19]

Knight et al.

[11] Patent Number: 5,833,449

[45] Date of Patent: Nov. 10, 1998

[54] TWO PIECE MULTIPLE INSHOT-TYPE FUEL BURNER STRUCTURE

[75] Inventors: John T. Knight; Scott A. Willbanks, both of Fort Smith; Joey W. Huffaker, Rudy; Kenneth F. Thereau, Mountainburg, all of Ark.; Richard J. Bazzo, Broadview Heights, Ohio; Jacob J. Verderber, Jr., deceased, late of Fort Smith, Ark., by John D. Alford, executor

[73] Assignee: Rheem Manufacturing Company, New York, N.Y.

[21] Appl. No.: 756,573

[22] Filed: Nov. 26, 1996

[51] Int. Cl.[6] ..... F24C 3/10

[52] U.S. Cl. ..... 431/191; 126/110 R; 126/39 R; 126/116 R; 431/354; 431/114

[58] Field of Search ..... 126/110 R, 34 R, 126/116 R; 431/191, 354, 114

[56] References Cited

U.S. PATENT DOCUMENTS

| | | | |
|---|---|---|---|
| 1,278,037 | 9/1918 | Shanklin . | |
| 1,942,397 | 1/1934 | Cuyler | 158/104 |
| 3,099,312 | 7/1963 | Radley et al. | 158/106 |
| 3,198,238 | 8/1965 | Hughes | 158/104 |
| 3,799,452 | 3/1974 | Hein | 239/553.3 |
| 5,035,609 | 7/1991 | Riehl | 431/286 |
| 5,108,284 | 4/1992 | Gruswitz | 431/286 |
| 5,131,839 | 7/1992 | Riehl | 431/286 |
| 5,176,512 | 1/1993 | Eyens | 431/354 |

*Primary Examiner*—Larry Jones
*Attorney, Agent, or Firm*—Konneker & Smith, P.C.

[57] ABSTRACT

A multiple inshot-type gas burner structure is formed from a pair of facing, intersecured stamper sheet metal plates. A spaced plurality of parallel, rectangularly cross-sectioned burner bodies are defined by facing triangular indentation pairs in the plates and have, at front outlet end portions thereof, side indentations which serve to mix air and gaseous fuel received at rear end portions of the burner bodies, and to divert a portion of the fuel/air mixture into crossover channels intercommunicating front interior portions of the burner bodies. The crossover channels have central arcuate closed portions that cooperate with progressively sized standoff dimples extending between opposite wall portions of the channels to provide an even crossover flame pattern along the outlet slot section of each channel. At the outlet end of each burner are four flame retention tabs which are transverse to the flow axis of the burner body and serve to prevent induced secondary combustion air from causing undesirable main flame liftoff. Originally rectangular inlet end portions of the burner bodies are laterally inwardly deformed to define generally circular sections that receive and firmly hold hexagonal gas supply orifice fittings mounted on a gas supply manifold pipe. Immediately forward of these deformed circular sections a plurality of primary air inlet openings are formed through the burner body walls.

22 Claims, 3 Drawing Sheets

TWO PIECE MULTIPLE INSHOT-TYPE FUEL BURNER STRUCTURE

BACKGROUND OF THE INVENTION

The present invention generally relates to burner apparatus for fuel-fired heating appliances and, in a preferred embodiment thereof, more particularly relates to a multiple inshot-type fuel burner structure formed from two facing, intersecured stamped metal sheets.

Draft induced fuel-fired furnaces, such as gas fired air heating furnaces, are conventionally provided with heat exchanger structures having multiple sections with inlets arranged in a row. The row of heat exchanger section inlets is typically served by a corresponding spaced series of inshot-type fuel burners arranged in a row facing and parallel to the row of heat exchanger section inlets. During operation of the furnace, gaseous fuel is drawn into the burners from an external fuel source, mixed with primary combustion air drawn into the interior of the burners, ignited, and then drawn into and through the heat exchanger via its individual inlets. At the same time a blower portion of the furnace forces a flow of air being recirculated to and from a conditioned space served by the furnace externally over the heat exchanger to remove combustion heat therefrom and thereby heat the recirculating air.

Because there may be a relatively large number of inshot-type burners incorporated in a fuel-fired furnace of this general type, various techniques have been proposed to simplify and reduce the cost of the burner portion of the furnace. For example, as illustrated in U.S. Pat. No. 5,035,609 to Riehl, it has been previously proposed to make each individual inshot-type burner primarily from two opposing sheet metal stampings, and then join the individual burners at adjacent corner portions of wing-like flame carryover sections incorporated into each burner outlet portion. These flame carryover sections extend between each burner body outlet and serve to provide a flame path from the ignited burner to an adjacent burner.

Each burner body has a generally circular cross-section along its length, with a necked down longitudinally intermediate venturi section formed therein. To inhibit undesirable axial flame "lift-off" during burner operation, two separate flame retainer members are secured in an opposing relationship on opposite exterior side sections of each burner outlet end portion. Other similar burner designs rely on separate outlet end portion inserts to obtain this flame retention function. Another previously proposed multiple inshot-type burner design is shown in U.S. Pat. No. 5,176,512 in which a spaced plurality of tubular, venturi-sectioned burners are integrally formed in two opposing sheet metal stampings so that the individual burner bodies are automatically held in the requisite parallel burner row.

Various well known problems, limitations and disadvantages have been typically associated with these and other types of conventional inshot-type burner assemblies. For example, many conventional inshot-type burner structures require complex stamping shapes and are difficult and time consuming to assemble in the requisite aligned row with precisely parallel main flame axes. Additionally, the provision of adequate flame retention to prevent axial flame separation from the individual burner outlets conventionally requires multiple additional components such as the separate side shields and burner body outlet insert structures mentioned above.

Moreover, each separate inshot-type burner is typically fed with gaseous fuel from an orifice nozzle connected to a gas manifold pipe and received in an inlet end nozzle receiving portion of the burner body. Various conventional designs for this receiving portion have not proven to be entirely satisfactory due to various mechanical support instabilities presented by such conventional designs. In addition to these various structural problems presented by conventionally designed inshot-type fuel burners, they often present performance problems as well. For example, various conventionally designed burners of this general type often create undesirable main and carryover flame shapes during their operation. As to the main burner flame, this shape deficiency often manifests itself in an overly wide flame that tends to laterally overlap its associated heat exchanger section inlet opening, thereby potentially damaging the heat exchanger inlet section over time.

From the foregoing it can be seen that it would be highly desirable to provide an improved multiple inshot-type fuel burner structure that eliminates, or at least substantially minimizes the above-mentioned problems, limitations and disadvantages of conventional inshot-burners of the type generally described herein. It is accordingly an object of the present invention to provide such an improved multiple inshot-type fuel burner structure.

SUMMARY OF THE INVENTION

In carrying out principles of the present invention, in accordance with a preferred embodiment thereof, a two piece multiple inshot-type fuel burner structure is formed from first and second essentially identically configured deformed metal sheet members joined in a side-to-side facing relationship. According to various aspects of the invention the burner structure has several unique structural and operational features incorporated therein.

For example, to simplify the stamping process used to manufacture the burner structure the deformed first and second metal sheet members are configured to define a spaced plurality of generally rectangularly cross-sectioned fuel burner bodies extending along parallel axes and having open rear inlet end portions positioned at a rear side edge of the structure, and open front outlet end portions positioned at a front side edge of the structure. Each body is preferably defined by two opposing deformed triangular sections of the sheet members.

During operation of the burner structure, streams of air and gaseous fuel are flowed forwardly through the interiors of the burner bodies, and ignited to create flames and resulting hot combustion gases that are forwardly discharged from the outlet ends of the burner bodies. Laterally spaced pluralities of transverse flame retention tabs are formed on the outlet ends of the burner bodies, are aligned with the front side edge of the burner structure, and function to prevent undesirable axial flame "lift-off" at the burner body outlet ends by intercepting and blocking induced flows of secondary combustion air externally flowing forwardly along the burner bodies.

Extending transversely between the outlet end portions of each adjacent burner body pair, and communicating their interiors, is a crossover chamber that is defined by facing spaced apart portions of the first and second metal sheet members and has an open discharge edge slot aligned with the front side edge of the burner structure. During operation of the burner structure, a portion of the fuel/air mixture internally traversing each burner body is flowed into its associated crossover chamber(s) and outwardly through the associated crossover chamber discharge edge slot(s) to light the remaining burners from the initially ignited one.

According to another feature of the invention, mixing depressions are formed in the outlet end portions of the burner bodies in each of the walls that define the opposing triangular deformed sections. These depressions help to mix the streams of air and gaseous fuel internally traversing the burner bodies, with each depression preferably having an axially elongated body portion with front and rear ends. Extending transversely from a front end of each depression body portion, toward the apex edge of its associated triangular burner body section, is a flame flashback inhibiting section that serves to inhibit undesirable rearward flashback of the main burner body flame. Somewhat to the rear of each flame flashback inhibiting section is a transverse fuel/air mixture deflector section that extends toward the base of the triangular burner body section and serves to facilitate the diversion of a portion of the fuel/air mixture internally traversing a burner body into an associated crossover chamber.

In accordance with another feature of the invention, pressure balancing structures are incorporated in the crossover chambers and function to generally equalize the fuel/air mixture discharge pressure along the lengths of the crossover chamber discharge slots. Representatively, the pressure balancing structures are formed by inwardly projecting spaced pluralities of dimples formed in the opposing wall portions of the crossover chambers and arranged in rows parallel to their discharge edge slots. The dimples in each row are relatively configured and arranged in a manner such that at each discharge edge slot a resistance to fuel/air mixture outflow therefrom is created that is greatest at a longitudinally central portion of the edge slot and progressively decreases, along the remaining lengths of the discharge slot toward opposite end portions thereof.

The general fuel/air mixture pressure equalization along each crossover chamber discharge edge slot is preferably facilitated by a special configuration of the crossover chambers that extend between the outlet end portions of each adjacent pair of fuel burner bodies. Specifically, each crossover chamber has a rear side edge that is rearwardly spaced apart from and parallel to the discharge edge slot of the crossover chamber, and is preferably aligned with the rear ends of the burner body side wall mixing depressions. An arcuate depression is formed along a major central portion of this rear side edge of the crossover chamber, with the convex side of the arcuate depression facing the front side discharge slot of the crossover chamber.

In accordance with yet another aspect of the present invention, each burner body rear inlet end portion is laterally inwardly deformed, relative to the balance of its associated rectangularly cross-sectioned burner body, to create a generally circularly configured fuel supply orifice receiving and support portion of the burner body disposed rearwardly of an open rear air inlet end portion of the balance of the burner body. This feature of the burner body structure facilitates the stable receipt and support of fuel supply orifice nozzles in rear end portions of the plurality of separate inshot-type fuel burner bodies.

DETAILED DESCRIPTION

Figure 1:
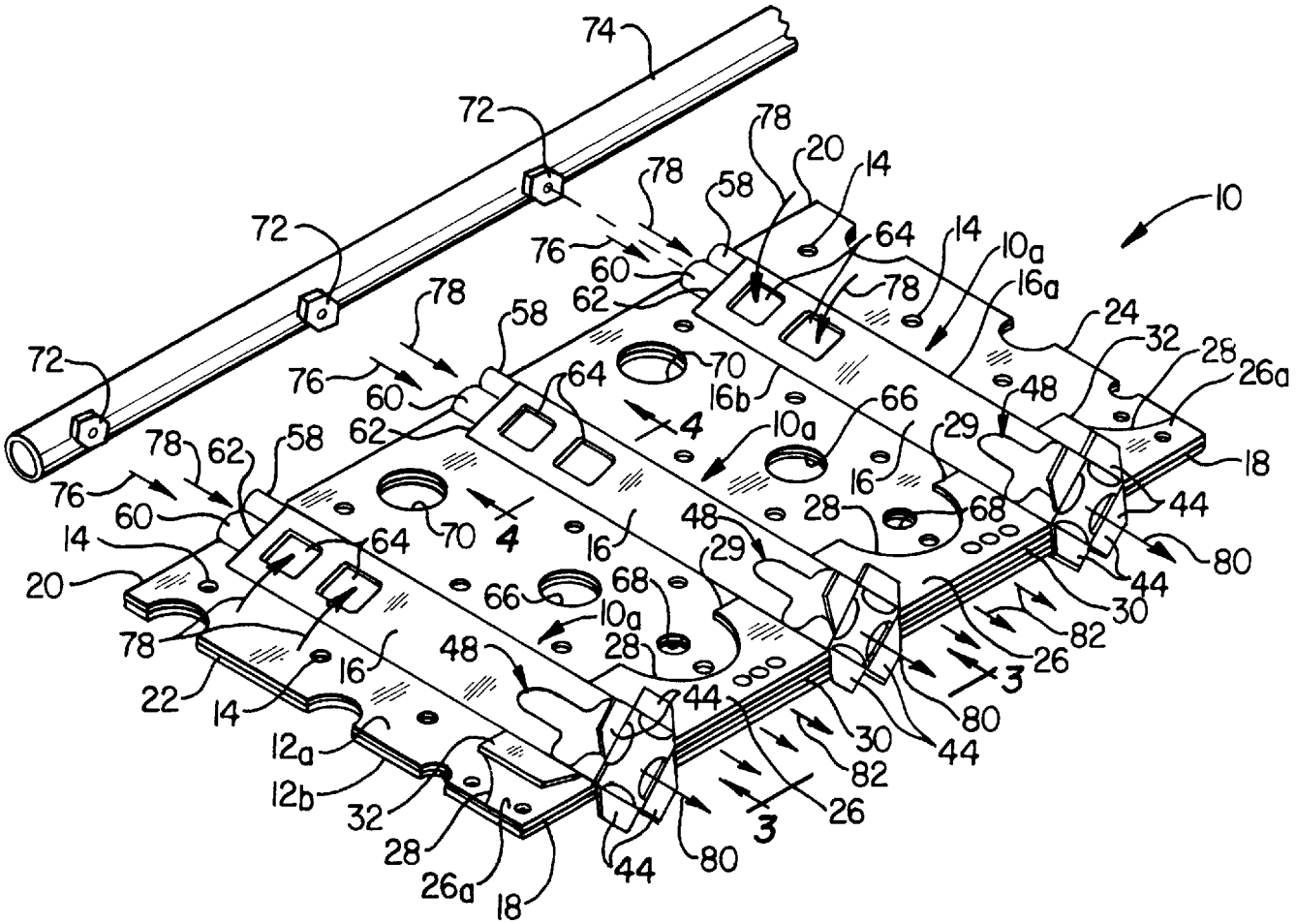
FIG. 1 is a partially exploded perspective view of a two piece multiple inshot-type fuel burner structure embodying principles of the present invention, and an associated orificed gaseous fuel manifold pipe operatively associated therewith.

With reference now to FIGS. 1—4 of the accompanying drawings, the present invention provides a specially designed two piece, stamped sheet metal multiple burner structure 10 representatively having three laterally spaced, parallel inshot-type fuel burner portions 10*a* with rectangular (illustratively square) cross-sections along their lengths. As will readily be appreciated by those of skill in this particular art, a greater or lesser number of individual burners 10*a* could be incorporated in the structure as necessary or desirable.

According to a key advantage of the present invention, the entire multi-burner structure 10 is conveniently and economically constructed from two identically configured stamped top and bottom sheet metal sections 12*a*,12*b* that are cut from an elongated stamping sheet and then intersecured, by mechanical fastening deformations 14, in the illustrated opposed, facing relationship. The individual fuel burner portions 10*a* are combinatively defined by raised, triangularly cross-sectioned body sections 16 formed on each of the sheet metal sections 12*a*,12*b* and arranged in opposing pairs to form the illustrated hollow, generally rectangularly cross-sectioned body sections of the individual burner portions 10*a*. Each triangular body section 16 has, along its length, an apex edge 16*a* and a pair of base edges 16*b*.

As illustrated, the elongated burner bodies 10*a* are arranged in a laterally spaced, longitudinally parallel relationship along the length of the overall burner structure 10 and extend lengthwise between front and rear side edges 18,20 of the structure. Aligned end edges of the top and bottom sheet metal sections 12*a*,12*b* also define corresponding left and right end edges 22,24 of the overall burner structure 10. In the representatively illustrated three-burner structure 10 illustrated in FIGS. 1 and 2, therefore, there are representatively two "end" burners 10*a* positioned adjacent the left and right end edges 22 and 24, and a "central" burner 10*a* disposed between the end burners. Opposing portions of the facing top and bottom sheet metal sections 12*a*,12*b* are raised to form therebetween crossover fuel chambers 26 extending between each adjacent burner body portion pair at outlet end portions of the burner body portions (i.e., right end portions of the burner body portions as viewed in FIG. 1, and bottom end portions of the burner body portions as viewed in FIG. 2). Crossover fuel chambers 26 have generally rectangular configurations, elongated in a direction transverse to the lengths of the burner body portions 10*a*, and have arcuate indentations 28 formed between essentially straight, opposing inside edge portions 29 thereof. These crossover fuel chambers 26 communicate along opposite end portions thereof with the interiors of their associated burner body portions 10*a* and have open flame outlet side edge slots 30 disposed between each adjacent pair of burner body portions 10*a*.

At the opposite ends of the burner structure 10 portions 26*a* of the crossover fuel chambers 26 are flattened, to bring facing portions of their opposite walls 12*a*,12*b* together, in a manner leaving a laterally truncated portion 32 of the previous chamber 26 intact, each of the two illustrated truncated portions 32 having a sloping end portion 34 spaced inwardly from the front side edge 18 and disposed oppositely from an associated inner crossover chamber side edge portion 29.

The interior height of each of the two illustrated crossover fuel chambers 26 is essentially constant along its entire area, including the portion thereof extending along its associated outlet edge slot 30. The portions of the walls 12*a*,12*b* on opposite sides of each chamber 26 are held apart from one another by three inwardly projecting inner, intermediate and outer dimples 36,38,40 (see FIGS. 2 and 3) formed in each of the walls 12*a*,12*b* and arranged in a row of six dimples positioned inwardly and extending generally parallel to the two flame outlet edge slots 30.

Figure 3:
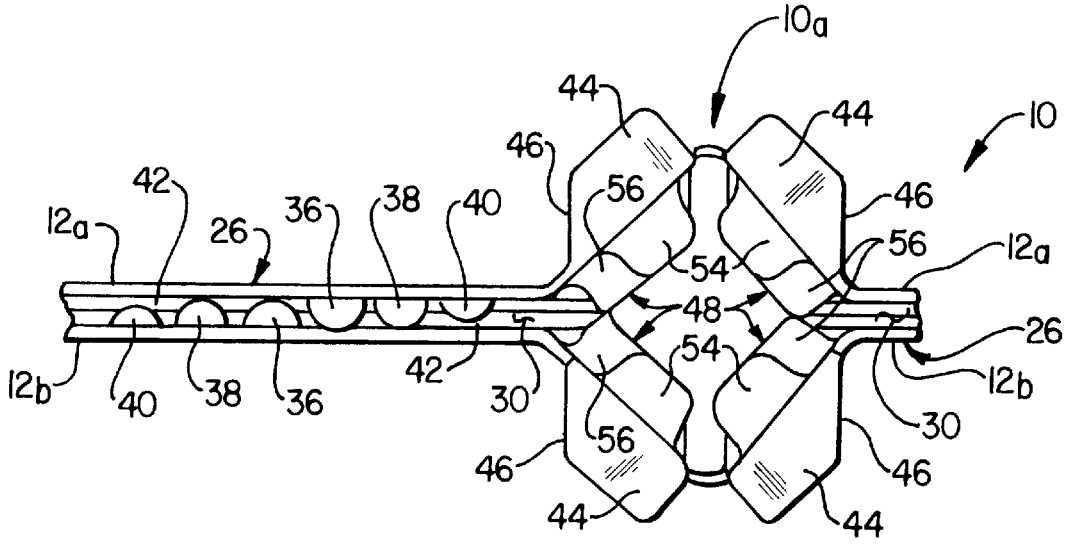
FIG. 3 is an enlarged scale partial front side elevational view of the burner structure taken along line 3—3 of FIG. 1.

For purposes later described, these dimples 36,38,40 are specially configured and positioned to improve the performance of the burner structure 10. Dimples 36,38 and 40 have generally oval cross-sections and, as best illustrated in FIG. 3, on each wall 12*a*,12*b* the widths of dimple 36 38 are generally equal and wider (in a direction transverse to the lengths of the burner body portions 10*a*) than the width of the dimple 40. The dimples 36 and 38 on each wall 12*a*,12*b* touch the opposite wall, but the dimples 40 do not, and form small gaps 42 with the opposing wall 12*a* or 12*b* as the case may be. Additionally, there are small horizontal gaps between the three dimples 36,38,40 on each wall 12*a*,12*b*, as well as a small horizontal gap between the two adjacent dimples 36.

Figure 2:
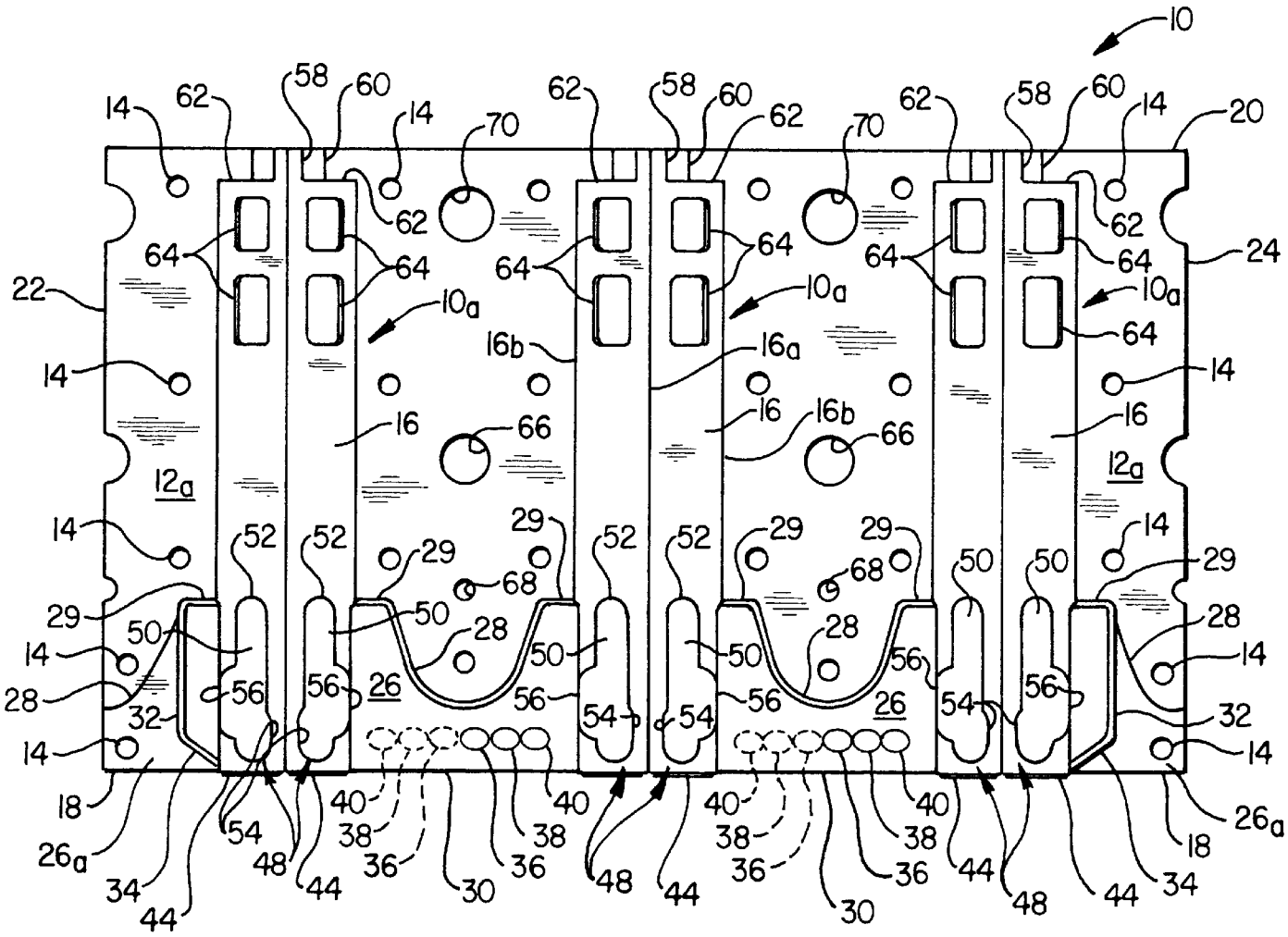
FIG. 2 is an enlarged scale top plan view of the burner structure.

With reference now to FIGS. 1—3, at the outlet end of each burner body portion 10*a* are four outwardly projecting transverse flame retention tabs 44—one on each of the four walls of the rectangularly cross-sectioned burner body—generally aligned with the front side edge 18 of the burner structure 10 and lying in planes perpendicular to the parallel portions of the sheet metal sections 12*a*,12*b* between the burner bodies 10*a*. As illustrated, each tab 44 has an outer vertical side edge 46 which is transverse to the sheet metal sections 12*a*,12*b* between the burner bodies 10*a*.

Immediately behind each of the transverse tabs 44 is a depression 48 formed in an outlet end portion of the wall of the triangular body section 16 on which the tab 44 is formed. Each depression 48 has an elongated body portion 50 longitudinally extending parallel to the length of the burner portion 10*a*, an inner end 52 generally aligned with the inside edge portions 29 of the crossover fuel chambers 26, a front transverse portion 54 extending from the body portion 50 toward the apex edge 16*a* of the associated triangular body section 16, and a longitudinally intermediate transverse portion 56 extending toward a base edge 16*b* of the triangular body section 16.

Figure 4:
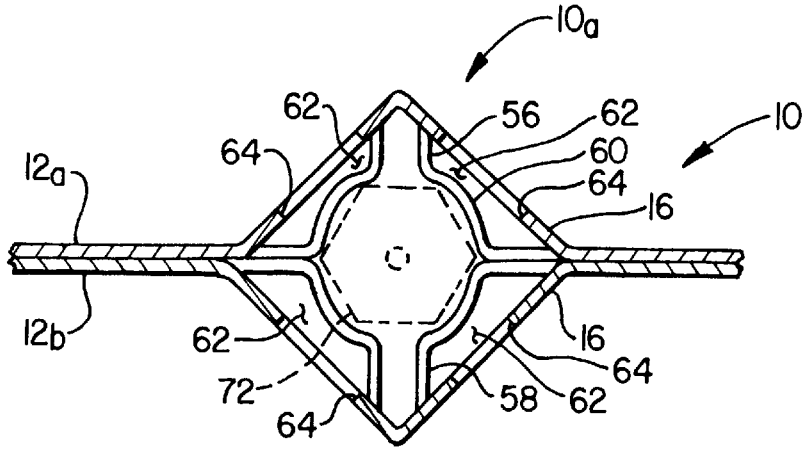
FIG. 4 is an enlarged scale partial cross-sectional view through the burner structure taken along line 4—4 of FIG. 1.

Turning now to FIGS. 1, 2 and 4, the initially rectangular rear or inlet ends of the individual burner portions 10*a* are deformed to define at each burner inlet end upper and lower lobe portions 58 projecting outwardly from a central, generally circular mounting portion 60, and four primary combustion air inlet openings 62 at the rear ends of the still-rectangular portion of the burner body portions 10*a*. These inlet end openings are supplemented by side inlet openings 64 formed in the walls of the triangular body sections 16 adjacent their inlet ends.

To facilitate the precise alignment of the facing stamped sheet metal sections 12*a*,12*b* prior to their intersecurement by the various mechanical fastening deformations 14, circular alignment holes 66, through which suitable alignment members may be temporarily inserted, are formed in the sections 12*a*,12*b*. Additionally formed in the sheet metal sections 12*a*,12*b* are burner structure mounting holes 68 inwardly adjacent the crossover fuel chambers 26, and wiring and control routing holes 70 inwardly adjacent the rear side edge 20 of the burner structure 10.

Operation of the Burner Structure 10

Various of the unique structural features of the two piece multiple inshot-type fuel burner structure 10 described above cooperate to provide the burner structure 10 with a variety of advantages over conventional inshot-type burner devices. For example, the burner structure 10 is quite easily installed in front of a spaced series of combustor tube inlets (not shown) of an induced draft, fuel-fired furnace by simply attaching the structure 10 to a suitable support member, using fasteners extended downwardly through the mounting holes 68, and then securing the support member to the furnace. The routing holes 70 provide paths for running various wiring necessary for the installation.

With the burner structure 10 in place, a spaced series of hexagonally shaped fuel orifice nozzles 72 (see FIG. 1) operatively mounted on a fuel gas supply manifold pipe 74 are inserted into the circular central inlet portions 60 at the rear ends of the burner body portions 10*a* as illustrated in phantom in FIG. 4. Due to their configurations, these circular inlet portions 60 provide a substantially increased degree of nozzle support stability compared to, for example, a pair of notched tabs bent toward each other on opposite sides of each orifice nozzle as employed by some previously proposed inshot-type fuel burner designs.

Referring again to FIG. 1, during operation of the burner structure 10, fuel 76 from the nozzles 72 is injected into the rear inlet ends of the burner body portions 10*a* and is drawn forwardly through the interiors of the burner bodies and mixed therein with primary combustion air 78 being simultaneously drawn into the burner body portion interiors through the end and side air inlet openings 62 and 64. The fuel/air mixture exiting the discharge end of one of the burner body portions 10*a* is suitably ignited to form a main burner flame 80 and resulting hot combustion gases which are injected into the combustor tube inlet opening aligned with the particular burner body outlet end.

The flame created by the ignition of the fuel/air mixture at the first burner body portion 10*a* spreads via the crossover chambers 26 to create the other two main burner flames 80 and the schematically illustrated crossover chamber outlet slot flames 82 between each adjacent pair of burner body portions 10*a*. The previously mentioned flattening of the crossover chamber portions 26*a* at opposite front corner portions of the burner structure 10 advantageously prevents the propagation of crossover flames out the opposite ends of the burner structure 10 in directions transverse to the axes of the main flames 80.

The unique, generally rectangular cross-section of the burner body portions 10*a*, as opposed to the conventional circular burner body configurations with longitudinally intermediate reduced diameter venturi mixing sections, substantially simplifies the stamping portion of the fabrication of the burner structure 10. In place of the conventional mid-length circularly cross-sectioned venturi section, the discharge end depressions 48 formed in the four walls of each burner body portion 10*a* serve to enhance the mixing of the fuel and combustion air being drawn forwardly through the interior of the burner body portions 10*a*.

At the discharge ends of the burner body portions 10*a* the transverse tabs 44 act as blocking shields to prevent induced flows of secondary air, moving forwardly in a longitudinal direction along the exteriors of the burner body portions 10*a*, from adversely affecting the main burner flames 80 by causing them to axially "lift off" and become separated from the discharge ends of the burner body portions 10*a*. Tabs 44 thus quite effectively act as flame retainer members positioned essentially transversely to the axes of the main burner flames 80 and positioned generally in alignment with the front side edge 80 of the burner structure 10.

With reference now to FIGS. 2 and 3, the lateral depressions 48 formed in the discharge ends of the burner body portions 10*a* serve not only to enhance the mixing of the gaseous fuel and air internally traversing the burner bodies, but also uniquely perform two other useful functions during operation of the burner structure 10. Specifically, the front transverse portions 54 of the depressions 48 serve as restrictions to inhibit main burner flame flashback into the interiors of the burner bodies, and the intermediate transverse portions 56 of the depressions 48 function to deflect a portion of the fuel/air mixture flowing through the burner bodies 10*a* laterally into the crossover chambers 26 to effect crossover lighting of burners from an initially ignited one.

Once the fuel/air mixture enters the crossover chambers 26 between the adjacent pairs of burner body portions 10*a* its pressure profile horizontally across each open flame outlet edge slot 30 is generally equalized by the specially designed configurations of and cooperation between the crossover chambers 26 and the opposing sets of dimples 36,38,40 therein. Specifically, the arcuate indentations 28 in the crossover chambers 26, in combination with the inside edge portions 29 of the chambers 26 generally aligned with the inner ends 52 of the burner body side indentations 48 tend to more evenly distribute the fuel/air mixture outflow through the outlet edge slots 30 than is the case with conventionally configured crossover chambers.

This desirable horizontal evening of the fuel/air mixture discharge flow along the lengths of the outlet slots 30 is further enhanced by the patterning and relative sizing of the dimple sets 36,38,40. As can best be seen in FIG. 3, the oppositely facing sets of dimples 36,38,40 disposed within each full crossover chamber 26 provide at each outlet slot 30 a resistance to fuel/air mixture outflow from the slot which is greatest at the horizontal center of the slot and progressively decreases toward the opposite horizontal ends of the slot. Additionally, the slight gaps 42 between the smallest dimples 40 and their opposing sheet metal plate walls facilitates the lateral propagation of the crossover flames 82 from burner body to burner body.

As can readily be seen from the foregoing, the present invention provides a multiple inshot-type fuel burner structure 10 that is of a simple design, is relatively easy and inexpensive to manufacture, has only two parts, provides automatic parallel alignment of its burner body sections, and provides enhanced performance compared to multiple inshot-type burner assemblies of conventional design.

The foregoing detailed description is to be clearly understood as being given by way of illustration and example only, the spirit and scope of the present invention being limited solely by the appended claims.

What is claimed is:

1. A multiple inshot-type fuel burner structure comprising first and second deformed sheet members joined in a side-to-side facing relationship and combinatively defining a spaced plurality of fuel burner bodies extending along parallel axes and having open opposite inlet and outlet end portions, and a crossover chamber extending between each adjacent pair of said outlet end portions and communicating their interiors, each crossover chamber being defined by facing spaced apart portions of said first and second deformed sheet members and having an open discharge edge slot through which a fuel/air mixture received from the burner body outlet end portion interiors that the crossover chamber communicates may be discharged, each crossover chamber having a pressure balancing structure disposed therein and operative to generally equalize the fuel/air mixture discharge pressure along the length of the crossover chamber discharge slot, the pressure balancing structure in each crossover chamber being operative to provide along the length of its associated discharge edge slot a resistance to fuel/air mixture outflow therefrom that is greatest at a longitudinally central portion of the edge slot and progressively decreases, along the remaining lengths of the discharge slot toward opposite end portions of the discharge slot.

2. The fuel burner structure of claim 1 wherein said first and second deformed sheet members are deformed metal sheet members having essentially identical configurations.

3. The fuel burner structure of claim 1 wherein, in each crossover chamber, said pressure balancing structure is defined by a spaced series of sheet member depressions extending across the crossover chamber.

4. The fuel burner structure of claim 3 wherein, in each crossover chamber, said depressions are arranged in a row inwardly adjacent and generally parallel to the length of the discharge edge slot of the crossover chamber.

5. The fuel burner structure of claim 4 wherein, in each crossover chamber, the widths of the depressions in said row thereof generally parallel to the length of the row are greatest in a central portion of the row and progressively decrease toward the ends of the row.

6. The fuel burner structure of claim 5 wherein, in each crossover chamber, the depressions include spaced pluralities of depressions formed in each of said portions of said first and second deformed sheet members that define the crossover chamber and extending across the crossover chamber toward the other of the sheet member portions.

7. The fuel burner structure of claim 1 wherein, in each crossover chamber, said row of depressions include a longitudinally central pair of depressions extending completely across the crossover chamber, a pair of opposite end depressions extending only partially across the crossover chamber, and a pair of longitudinally intermediate depressions disposed between and spaced apart from said central and end depressions and extending completely across the crossover chamber.

8. A multiple inshot-type fuel burner structure comprising first and second deformed sheet members joined in a side-to-side facing relationship and having a front side edge portion, said sheet members combinatively defining a spaced plurality of generally rectangularly cross-sectioned fuel burner bodies extending along parallel axes transverse to said front side edge portion and having open opposite inlet and outlet end portions, said outlet end portions having opposite side portions terminating at said front side edge portion and having formed thereon laterally spaced pluralities of outwardly projecting flame retention tabs each extending substantially perpendicularly to said axis and generally aligned with said front side edge portion.

9. The fuel burner structure of claim 8 wherein each of said fuel burner bodies is defined by opposing, generally triangularly cross-sectioned deformed portions of said first and second sheet members.

10. The fuel burner structure of claim 8 wherein said first and second deformed sheet members are deformed metal sheet members having essentially identical configurations.

11. A multiple inshot-type fuel burner structure comprising first and second deformed sheet members joined in a side-to-side facing relationship and combinatively forming a spaced plurality of generally rectangularly cross-sectioned fuel burner bodies extending along parallel axes and having open rear inlet and front outlet end portions, each burner body being defined by opposing, generally triangularly cross-sectioned deformed portions of said first and second sheet members, each generally triangularly cross-sectioned deformed portion having a pair of mutually angled side walls meeting at an apex edge and having a base edge, each side wall having a depression formed therein along the front outlet end portion of the burner body with which the side wall is associated, the depressions forming in the burner bodies inwardly projecting structures that intercept and facilitate the mixing of flows of air and gaseous fuel forwardly traversing the interiors of the burner bodies.

12. The fuel burner structure of claim 11 wherein said first and second deformed sheet members are deformed metal sheet members having essentially identical configurations.

13. The fuel burner structure of claim 11 wherein, on each burner body, each of said depressions has an elongated body portion longitudinally extending parallel to the axis of the burner body and having front and rear ends.

14. A multiple inshot-type fuel burner structure comprising first and second deformed sheet members joined in a side-to-side facing relationship and combinatively forming a spaced plurality of generally rectangularly cross-sectioned fuel burner bodies extending along parallel axes and having open rear inlet and front outlet end portions, each burner body being defined by opposing, generally triangularly cross-sectioned deformed portions of said first and second sheet members, each generally triangularly cross-sectioned deformed portion having a pair of mutually angled side walls meeting at an apex edge and having a base edge, each side wall having a depression formed therein along the front outlet end portion of the burner body with which the side wall is associated, the depressions forming in the burner bodies inwardly projecting structures that intercept and facilitate the mixing of flows of air and gaseous fuel forwardly traversing the interiors of the burner bodies, on each burner body, each of said depressions having an elongated body portion longitudinally extending parallel to the axis of the burner body and having front and rear ends, on each of said side walls, the depression having a flame flashback inhibiting portion extending transversely from the elongated body portion toward the apex edge of the associated triangularly cross-sectioned deformed portion.

15. The fuel burner structure of claim 14 wherein the flame flashback inhibiting portion is positioned adjacent the front end of the elongated body section.

16. The fuel burner structure of claim 14 wherein, on each of said side walls, the depression further has a fuel/air mixture deflector portion extending transversely from the elongated body portion, rearwardly of the flame flashback inhibiting portion, toward the base edge of its associated side wall.

17. A multiple inshot-type fuel burner structure comprising first and second deformed sheet members joined in a side-to-side facing relationship and combinatively forming a spaced plurality of generally rectangularly cross-sectioned fuel burner bodies extending along parallel axes and having open rear inlet and front outlet end portions, each burner body being defined by opposing, generally triangularly cross-sectioned deformed portions of said first and second sheet members, each generally triangularly cross-sectioned deformed portion having a pair of mutually angled side walls meeting at an apex edge and having a base edge, each side wall having a depression formed therein along the front outlet end portion of the burner body with which the side wall is associated, the depressions forming in the burner bodies inwardly projecting structures that intercept and facilitate the mixing of flows of air and gaseous fuel forwardly traversing the interiors of the burner bodies, on each burner body, each of said depressions having an elongated body portion longitudinally extending parallel to the axis of the burner body and having front and rear ends, on each of said side walls, the depression having a fuel/air mixture deflector portion extending transversely from the elongated body portion toward the base edge of its associated side wall.

18. The fuel burner structure of claim 17 wherein the deflector portion is positioned at a longitudinally intermediate portion of the elongated body section.

19. A multiple inshot-type fuel burner structure comprising first and second deformed sheet members joined in a side-to-side facing relationship and combinatively defining a spaced plurality of fuel burner bodies extending along parallel axes and having open opposite rear inlet and front outlet end portions, and a crossover chamber extending between each adjacent pair of said outlet end portions and communicating their interiors, each crossover chamber being defined by facing spaced apart portions of said first and second deformed sheet members and having an open discharge edge slot through which a fuel/air mixture received from the burner body outlet end portion may be discharged, each crossover chamber having a rear side edge extending between its associated adjacent pair of fuel burner bodies and generally parallel to the discharge edge slot of the crossover chamber, and an arcuately inset portion formed in the rear side edge and spaced apart from each fuel burner body in the adjacent pair in a direction parallel to the rear side edge of the crossover chamber.

20. The fuel burner structure of claim 19 wherein each of said fuel burner bodies has, along its length, a generally rectangular cross-section defined by an opposing pair of triangularly configured deformed portions of said first and second sheet members each having a pair of side walls with fuel/air mixing depressions formed therein adjacent their associated burner body end outlet end portion, the depressions having rear ends generally aligned with the rear side edge of each crossover chamber.

21. The fuel burner structure of claim 19 wherein said plurality of fuel burner bodies include a pair of outer end bodies each having a partial crossover chamber extending outwardly beyond it in a direction transverse to the axes of said fuel burner bodies, each partial crossover chamber having an outer side section which is closed in a manner preventing a fuel/air mixture entering the partial crossover chamber from its associated fuel burner body from being discharged from the partial crossover chamber in a direction transverse to the burner body axes and parallel to said first and second sheet members.

22. A two piece multiple inshot-type fuel burner structure comprising first and second deformed metal sheet members joined in a side-to-side facing relationship, having essentially identical configurations and parallel front and rear side edges, and combinatively forming:

a spaced plurality of generally rectangularly cross-sectioned fuel burner bodies extending along parallel axes and having open rear inlet end portions and front outlet end portions, each fuel burner body axially extending between said front and rear side edges and being defined by opposing triangularly cross-sectioned deformed sections of said first and second metal sheet members having mutually angled side walls with fuel and air mixing depressions formed therein in their associated fuel burner outlet end portion, each fuel burner body having at its front end a laterally spaced plurality of transversely outwardly projecting flame retention tab portions aligned with said front side edge;

a crossover chamber extending between each adjacent pair of fuel burner bodies and communicating the interiors of their front outlet end portions, each crossover chamber being defined by facing spaced apart portions of said first and second deformed metal sheet members and having an open discharge edge slot extending along said front side edge and through which a fuel/air mixture received from the burner body outlet end portion interiors may be discharged;

a pressure balancing structure disposed in each crossover chamber and operative to generally equalize the fuel/air mixture discharge pressure along the length of the crossover chamber discharge slot; and a laterally inwardly deformed section disposed on the rear end of each inlet portion and defining thereon a generally circularly configured fuel supply orifice receiving and support portion of the associated fuel burner body disposed rearwardly of an open rear air inlet end portion of the balance of the fuel burner body.

* * * * *

UNITED STATES PATENT AND TRADEMARK OFFICE

CERTIFICATE OF CORRECTION

PATENT NO. : 5,833,449

DATED : November 10, 1998

INVENTOR(S) : John T. Knight, Scott A. Willbanks, Joey W. Huffaker, Kenneth F. Thereau, Richard J. Bazzo and Jacob J. Verderber, Jr. (deceased)

It is certified that error appears in the above-indentified patent and that said Letters Patent is hereby corrected as shown below:

Column 8, line 39, "claim 1" should be --claim 6--.

Signed and Sealed this

Twenty-third Day of November, 1999

*Attest:*

Q. TODD DICKINSON

*Attesting Officer*

*Acting Commissioner of Patents and Trademarks*